US007363887B2

(12) United States Patent
Jacobsen et al.

(10) Patent No.: US 7,363,887 B2
(45) Date of Patent: Apr. 29, 2008

(54) DYNAMIC MASS TRANSFER RAPID RESPONSE POWER CONVERSION SYSTEM

(75) Inventors: Stephen C. Jacobsen, Salt Lake City, UT (US); Marc Olivier, Sandy, UT (US)

(73) Assignee: Raytheon Sarcos, LLC, Waltham, MA (US)

( * ) Notice: Subject to any disclaimer, the term of this patent is extended or adjusted under 35 U.S.C. 154(b) by 0 days.

(21) Appl. No.: 11/293,621

(22) Filed: Dec. 1, 2005

(65) Prior Publication Data

US 2006/0144041 A1 Jul. 6, 2006

Related U.S. Application Data

(60) Provisional application No. 60/632,866, filed on Dec. 2, 2004.

(51) Int. Cl.
*F02M 23/00* (2006.01)

(52) U.S. Cl. ..... 123/46 R; 60/413

(58) Field of Classification Search ..... 123/46 R, 123/46 SC; 417/364, 380; 60/413
See application file for complete search history.

(56) References Cited

U.S. PATENT DOCUMENTS

| | | | |
|---|---|---|---|
| 179,782 | A | 7/1876 | Gilles |
| 1,308,811 | A | 7/1919 | Scott |
| 2,816,416 | A | 12/1957 | French |
| 3,170,406 | A | 2/1965 | Robertson |

(Continued)

FOREIGN PATENT DOCUMENTS

| | | |
|---|---|---|
| DE | 3410491 | 9/1985 |

(Continued)

*Primary Examiner*—Stephen K. Cronin
*Assistant Examiner*—Hyder Ali
(74) *Attorney, Agent, or Firm*—Thorpe North & Western LLP

(57) ABSTRACT

The present invention features a rapid fire rapid response power conversion system comprising (a) a chamber having at least one fluid port configured to supply combustible fluid to the chamber, and an out-take port; (b) a compressor for supplying compressed combustible fuel to the chamber at a variable pressure to at least partially facilitate combustion therein; (c) a controller for initiating and controlling a combustion of the combustible fluid in a combustion portion of the chamber to generate energy; (d) a rapid response component in fluid communication with the chamber and situated adjacent the combustion portion of the chamber, wherein the rapid response component is configured to draw an optimized portion of the energy generated from the combustion and to convert this optimized portion of energy into kinetic energy; and (e) a dynamic mass structure situated between the rapid response component and an energy transfer component and allowing the rapid response component and the energy transfer component to be independent of one another, wherein the dynamic mass structure is configured to receive and store the kinetic energy from the rapid response component upon being acted upon by the rapid response component, wherein the dynamic mass structure is displaced a pre-determined distance and at a given velocity such that it is caused to impact the energy transfer component, thereby transferring substantially all of the kinetic energy stored therein into the energy transfer component. The transfer of stored kinetic energy into the energy transfer component by the dynamic mass structure effectively causes the energy transfer component to displace, wherein the displacement is used to perform work used to power the device or system operable with the energy transfer component.

28 Claims, 8 Drawing Sheets

U.S. PATENT DOCUMENTS

| | | | |
|---|---|---|---|
| 3,234,395 | A | 2/1966 | Colgate |
| 3,274,946 | A | 9/1966 | Simmons |
| 3,604,204 | A | 9/1971 | Hans-Joachim |
| 3,868,931 | A | 3/1975 | Dutry et al. |
| 3,918,851 | A | 11/1975 | Fitzgerald |
| 4,090,479 | A | 5/1978 | Kaye |
| 4,167,922 | A | 9/1979 | Doundoulakis |
| 4,306,680 | A | 12/1981 | Smith |
| 4,554,943 | A | 11/1985 | Claney et al. |
| 4,599,983 | A | 7/1986 | Omachi |
| 4,907,549 | A | 3/1990 | Morikawa et al. |
| 5,109,810 | A | 5/1992 | Christenson |
| 5,261,797 | A * | 11/1993 | Christenson ..... 417/380 |
| 5,685,215 | A | 11/1997 | Jepsen et al. |
| 5,894,730 | A | 4/1999 | Mitchell |
| 6,029,616 | A | 2/2000 | Mayne et al. |
| 6,241,488 | B1 | 6/2001 | Luoto |
| 6,244,226 | B1 | 6/2001 | Berlinger et al. |
| 6,626,650 | B1 | 9/2003 | Kenchington et al. |
| 6,957,631 | B2 | 10/2005 | Jacobsen et al. |

FOREIGN PATENT DOCUMENTS

| | | |
|---|---|---|
| FR | 527 395 | 12/1913 |
| GB | 2003548 | 9/1979 |

* cited by examiner

DYNAMIC MASS TRANSFER RAPID RESPONSE POWER CONVERSION SYSTEM

This application claims priority to U.S. Provisional Patent Application No. 60/632,866, filed Dec. 2, 2004 in the United States Patent and Trademark Office, and entitled, "Dynamic Mass Transfer Rapid Response Power Conversion System," which application is incorporated by reference in its entirety herein.

FIELD OF THE INVENTION

The present invention relates generally to power conversion systems that utilize an internal combustion engine to generate energy from its combustion cycles and a power conversion device configured to extract the generated energy and convert it into usable energy or work. More specifically, the present invention relates to a dynamic mass transfer rapid response power conversion system and method for rapidly extracting and converting the energy produced by an internal combustion engine, wherein the internal combustion engine operates independent of an energy transfer component used to convert the generated energy to usable power, thus allowing the extraction of energy to be optimized.

BACKGROUND OF THE INVENTION AND RELATED ART

There are many different types of primary power sources available that convert fossil and other fuels into usable energy or power designed to perform work for one or more purposes. Some of the applications utilizing such power sources include everyday common items, such as motor vehicles, lawn mowers, generators, hydraulic systems, etc. Perhaps the best known example of a primary power source is the well known internal combustion engine, which converts the energy obtained or generated from the combustion of fossil fuel into usable energy, such as mechanical energy, electrical energy, hydraulic energy, etc. Indeed, an internal combustion engine has many uses both as a motor and as a power source used to drive or actuate various items, such as a pump. Converting fossil fuels into usable energy is also accomplished in large electricity plants, which supply electric power to power grids accessed by thousands of individual users.

While primary power sources have been successfully used to perform the several functions described above, they have not been successfully used independently in many applications because of their relatively slow response characteristics. Although large amounts of energy are contained within a single drop of fuel, internal combustion engines are particularly problematic in powering small devices, and particularly robotic devices and other similar systems that utilize a feedback loop to make real time adjustments in the movement of the mechanical structure being driven. In a robotic or any other system requiring rapid response, the power source typically must be able to generate output power that is capable of instantaneous or near instantaneous correction, as determined by the feedback received, that is necessary to maintain proper operation of the robotic device. Primary power sources utilizing fossil fuels for energy production have proved difficult or largely unworkable in these environments.

The response speed or response time of a power source functioning within a mechanical system, which response time is more accurately referred to as the system's bandwidth, is an indication of how quickly the energy produced by the power source can be converted, accessed, and utilized by an application. One example of a rapid response power system is a hydraulic power system. In a hydraulic system, energy from any number of sources can be used to pressurize hydraulic fluid, which pressurized fluid is stored in an accumulator for later use. This is what is meant by charging the accumulator. The energy contained in the stored pressurized fluid can be accessed almost instantaneously by opening a valve in the system and releasing the fluid in the accumulator for the purpose of performing work, such as extending or retracting a hydraulically driven actuator. The response time of this type of hydraulic system is very rapid, on the order of a few milliseconds or less.

An example of a relatively slow response power conversion system is the internal combustion engine, as discussed above. The accelerator on a vehicle equipped with an internal combustion engine controls the rotational speed of the engine, measured in rotations or revolutions per minute ("rpm"). When power is desired, the accelerator is activated and the engine increases its rotational speed accordingly. Setting aside impedance factors, the engine cannot reach the desired change in a very rapid fashion due to several inertial forces internal to the engine and the nature of the combustion process. If the maximum rotational output of an engine is 7000 rpm, then the time it takes for the engine to go from 0 to 7000 rpm is a measure of the response time of the engine, which can be a few seconds or more. Moreover, if it is attempted to operate the engine repeatedly in a rapid cycle from 0 to 7000 rpm and back to 0 rpm, the response time of the engine slows even further as the engine attempts to respond to the cyclic signal. In contrast, a hydraulic cylinder can be actuated in a matter of milliseconds or less, and can be operated in a rapid cycle without compromising its fast response time.

For this reason, many applications utilizing slow response primary power systems (such as an internal combustion engine) require the energy produced by the primary power source to be stored in another, more rapidly responsive energy system capable of holding the energy in reserve so that the energy can be accessed later instantaneously. One example of such an application is heavy earth moving equipment, such as backhoes and front end loaders, which utilize the hydraulic pressure system discussed above. Heavy equipment is generally powered by an internal combustion engine, usually a diesel engine, which supplies ample power for the maneuvering and driving of the equipment, but is incapable of meeting the energy response requirements of the various functional components, such as the bucket or backhoe. By storing and amplifying the power from the internal combustion engine in the hydraulic system, the heavy equipment is capable of producing, in a rapid response, great force with very accurate control. However, this versatility comes at a cost. In order for a system to be energetically autonomous and be capable of rapid, precise control, more component parts or structures are required, thus increasing the weight of the system and its operating costs.

Another example of a rapid response power supply is an electrical supply grid or electric storage device such as a battery. The power available in the power supply grid or battery can be accessed as quickly as a switch can be opened or closed. A myriad of motors and other applications have been developed to utilize such electric power sources. Stationary applications that can be connected to the power grid can utilize direct electrical input from the generating source. However, in order to use electric power in a system without tethering the system to the power grid, the system must be configured to use energy storage devices such as batteries, which can be very large and heavy. As modern technology moves into miniaturization of devices, the extra weight and volume of the power source and its attendant conversion hardware are becoming major hurdles against meaningful progress.

The complications inherent in using a primary power source to power a rapid response source become increasing problematic in applications such as robotics. In order for a robot to accurately mimic human movements, the robot must be capable of making precise, controlled, and timely movements. This level of control requires a rapid response system such as the hydraulic or electric systems discussed above. Because these rapid response systems require power from some primary power source, the robot must either be part of a larger system that supplies power to the rapid response system or the robot must be directly equipped with one or more heavy primary power sources or electric storage devices. Ideally, however, robots and other applications should have minimal weight, and should be energetically autonomous, not tethered to a power source with hydraulic or electric supply lines. To date, however, technology has struggled to realize this combination of rapid response, minimal weight, effective control, and autonomy of operation.

SUMMARY OF THE INVENTION

In light of the problems and deficiencies inherent in the prior art, the present invention seeks to overcome these by providing a dynamic mass transfer, rapid response, power conversion system (DRPS) comprising an internal combustion engine that operates to generate energy from a combustion of a combustible fluid and a rapid response component that extracts an optimized portion of the energy generated from the combustion. The DRPS further comprises an energy transfer component that operates independent of the rapid response component and internal combustion engine, which energy transfer component receives the energy from the rapid response component through a dynamic mass structure situated between the rapid response component and the energy transfer component.

Therefore, it is an object of some of the exemplary embodiments of the present invention to operate an internal combustion engine to generate energy.

It is another object of some of the exemplary embodiments of the present invention to optimize the operation of a rapid response component configured to extract the energy generated in the combustion and convert it into kinetic energy.

It is still another object of some of the exemplary embodiments of the present invention to transfer the kinetic energy in the rapid response component to an energy transfer component configured to convert the kinetic energy received into usable output power to power a device or system.

It is a further object of some of the exemplary embodiments of the present invention to operate the energy transfer component independent of the rapid response component, thus allowing the rapid response component to optimize the extraction of energy from the internal combustion engine.

It is still a further object of some of the exemplary embodiments of the present invention to transfer the kinetic energy stored in the rapid response component into a dynamic mass structure situated between the rapid response component and the energy transfer component, which dynamic mass structure impacts the energy transfer component, thereby effectuating a complete or substantially complete transfer of kinetic energy in the dynamic mass structure to the energy transfer component to optimize the output power of the system.

It is still a further object of some of the exemplary embodiments of the present invention to provide the DRPS using a two or four stroke internal combustion engine with either local or remote compression of combustible fluid, as well as any other type of engine configured to generate energy.

Although several objects of some of the various exemplary embodiments have been specifically recited herein, these should not be construed as limiting the scope of the present invention in any way. Indeed, it is contemplated that each of the various exemplary embodiments comprises other objects that are not specifically recited herein. These other objects will be apparent to and appreciated by one of ordinary skill in the art upon practicing the invention as taught and described herein.

To achieve the foregoing objects, and in accordance with the invention as embodied and broadly described herein, the present invention features a rapid fire rapid response power conversion system comprising (a) a chamber having at least one fluid port configured to supply combustible fluid to the chamber, and an out-take port; (b) a local compressor having a piston for supplying compressed combustible fluid to the chamber, wherein the piston and the at least one fluid port are configured to selectively provide a variable pressure to the chamber and to at least partially facilitate combustion therein; (c) a controller for initiating and controlling a combustion of the fluid in a combustion portion of the chamber to generate energy; (d) a rapid response component in fluid communication with the chamber and situated adjacent the combustion portion of the chamber, wherein the rapid response component is configured to draw an optimized portion of the energy generated from the combustion and to convert this optimized portion of energy into kinetic energy; and (e) a dynamic mass structure situated between the rapid response component and an energy transfer component and allowing the rapid response component and the energy transfer component to be independent of one another, wherein the dynamic mass structure is configured to receive and store all or substantially all of the kinetic energy from the rapid response component upon being acted upon by the rapid response component, wherein the dynamic mass structure is displaced some distance and at some velocity until it impacts the energy transfer component, thereby transferring substantially all of the kinetic energy stored therein into the energy transfer component. The transfer of stored kinetic energy into the energy transfer component by the dynamic mass structure effectively actuates the energy transfer component to perform work used to power the device or system operable with the energy transfer component. In another embodiment, the present invention rapid response power conversion system would comprise a remote compressor rather than a local compressor.

The present invention further features a method for powering a powered device comprising: (a) providing an internal combustion engine configured to generate energy from a combustion occurring within a combustion chamber and to power a powered device; (b) providing a rapid response component to be in fluid communication with the combustion chamber, wherein the rapid response component is configured to displace in response to the combustion and to extract the generated energy and convert the energy into kinetic energy; (c) providing an energy transfer component separate from and independent of the rapid response component, wherein the energy transfer component is operably coupled to the powered device and configured to power the powered device from the energy generated by the internal combustion engine; (d) operating the internal combustion engine to generate energy from the combustion; (e) configuring the rapid response component to displace in response to the combustion until substantially all of the generated energy is extracted, wherein the rapid response component converts the energy to kinetic energy; (f) providing a dynamic mass structure configured to interact with the rapid response component, wherein the dynamic mass structure is independent of the rapid response component and the energy transfer component; (g) causing the rapid response component to interact with the dynamic mass structure to transfer substantially all of the kinetic energy into the dynamic mass structure, wherein the interaction causes the dynamic mass component to displace; (h) configuring the dynamic mass structure to depart from the rapid response component at the moment, or just after to the moment, substantially all of the kinetic energy from the rapid response component has been transferred to the dynamic mass structure; and (i) causing the dynamic mass structure to impact the energy transfer component to transfer the kinetic energy of the dynamic mass structure into the energy transfer component, wherein the energy transfer component converts the kinetic energy into usable energy capable of powering and operating the powered device.

The present invention still further features a method for optimizing the output power of an internal combustion engine, wherein the method comprises: (a) operating an internal combustion engine to generate energy from a combustion occurring within a combustion chamber; (b) positioning a rapid response component in fluid communication with the combustion chamber, wherein the rapid response component is configured to extract and convert into kinetic energy the energy generated by the internal combustion engine; and (c) configuring and allowing the rapid response component to displace in response to the combustion until substantially all of the energy is extracted and converted into kinetic energy. The method further comprises providing an independent, displaceable dynamic mass structure configured to interact with the rapid response component to receive substantially all of the kinetic energy, wherein the dynamic mass structure is configured to depart from the rapid response component after substantially all of the kinetic energy is transferred to the dynamic mass structure.

BRIEF DESCRIPTION OF THE DRAWINGS

The present invention will become more fully apparent from the following description and appended claims, taken in conjunction with the accompanying drawings. Understanding that these drawings merely depict exemplary embodiments of the present invention they are, therefore, not to be considered limiting of its scope. It will be readily appreciated that the components of the present invention, as generally described and illustrated in the figures herein, could be arranged and designed in a wide variety of different configurations. Nonetheless, the invention will be described and explained with additional specificity and detail through the use of the accompanying drawings in which:

DETAILED DESCRIPTION OF EXEMPLARY EMBODIMENTS

The following detailed description of exemplary embodiments of the invention makes reference to the accompanying drawings, which form a part hereof and in which are shown, by way of illustration, exemplary embodiments in which the invention may be practiced. While these exemplary embodiments are described in sufficient detail to enable those skilled in the art practice the invention, it should be understood that other embodiments may be realized and that various changes to the invention may be made without departing from the spirit and scope of the present invention. Thus, the following more detailed description of the embodiments of the present invention, as represented in FIGS. 1 through 8, is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

The following detailed description and exemplary embodiments of the invention will be best understood by reference to the accompanying drawings, wherein the elements and features of the invention are designated by numerals throughout.

Generally, the present invention describes a method and system for generating energy from a rapid fire or other similar type of internal combustion engine and for converting that energy, through means of a unique dynamic mass transfer, rapid response, power conversion system (DRPS), into usable energy or power to operate a powered device at high bandwidths. The DRPS includes a dynamic mass structure that allows a rapid response component to extract an optimal amount of energy from the energy produced during the combustion cycles of the internal combustion engine, as well as to convert all of the extracted energy to kinetic energy. The dynamic mass structure receives the kinetic energy in the rapid response component and subsequently transfers all of this energy into an independently supported and operated energy transfer component via an impact.

Figure 1:
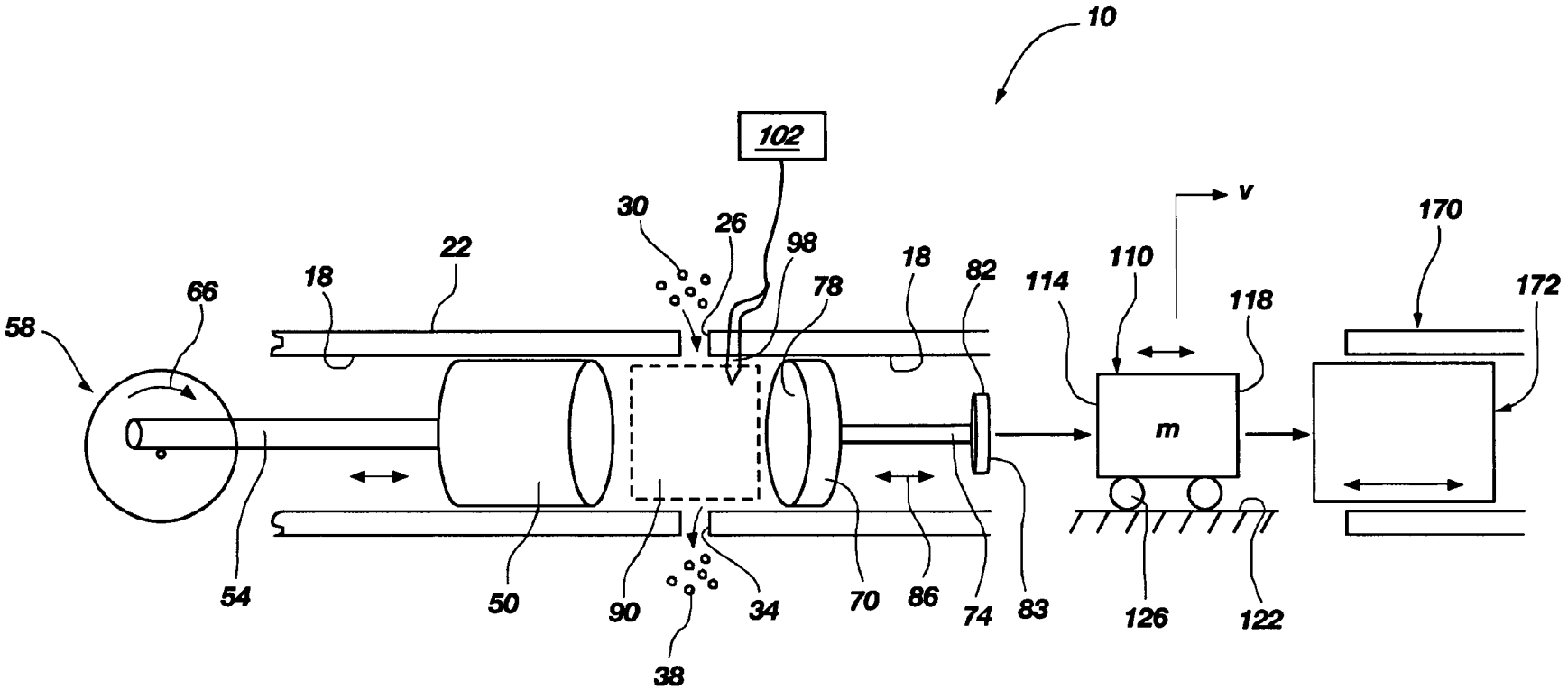
FIG. 1 illustrates a schematic side view of a DRPS according to one exemplary embodiment of the present invention.

Referring first to FIG. 1, illustrated is a simplified schematic view of a dynamic mass transfer rapid response power conversion 10 according to one exemplary embodiment of the present invention. Such a system 10 may partially include a typical internal combustion ("IC") engine, such as a four-stroke spark ignition IC engine, a two-stroke spark ignition rapid fire IC engine, or a diesel IC engine. Other types of engines may also be utilized with the present invention, such as compression ignition IC engines, non-combustion engines, or any other suitable engine. As shown, rapid response energy extracting system 10 is illustrated here in conjunction with a typical four-stroke spark ignition IC engine, wherein a single chamber 18 is depicted with the present invention.

The chamber 18 is defined by chamber walls 22 and includes one or more intake ports 26 for receiving a combustible fluid 30, such as fuel mixed with an oxidizer (e.g., air or oxygen), separately or as a mixture, and an out-take port 34 for releasing combusted exhaust gasses 38. Each of the intake port 26 and the out-take port 34 includes a valve (not shown), which is each configured to open and close at specified times to allow the combustible fluid 30 and exhaust gasses 38 to enter and exit the chamber 18, respectively. The chamber 18 includes a primary piston 50, a secondary piston 70 and a combustion portion 90 therebetween. The primary piston 50 is interconnected to a piston rod 54, which in turn is interconnected to a crank shaft 58. The primary piston 50 is sized and configured to generally move linearly within the chamber 18 for converting linear movement 62 from the primary piston 50 to the crank shaft 58 into rotational energy 66. Such rotational energy 66 may be used to power a wide range of external applications, such as any type of application that typically utilizes an IC combustion engine.

The linear movement 62 of the primary piston 50 takes place between a top dead center (TDC) position and a bottom dead center (BDC) position. The TDC position occurs when the piston 50 has moved to its location furthest from the crank shaft 58 and the BDC position occurs when the primary piston 50 has moved to its location closest to the crank shaft 58. The linear movement of the primary piston 50 between the TDC position and the BDC position may be generated by cyclic combustion in the combustion portion 90 of the chamber 18. Primary piston 50 may also move linearly within chamber 18 by other suitable means, such as an electric motor using energy from a battery.

A four-stroke cycle of an IC engine begins with the piston 50 located at TDC. As the piston 50 moves toward BDC, a fuel and oxidizer or combustible mixture 30 is introduced into the chamber 18 through intake port 26, which may include one or more openings and may also be a variable opening for varying the flow and amount of fuel into the chamber 18. Once the fuel enters the chamber 18, the intake port 26 is closed and the piston 50 returns toward TDC, compressing the combustible mixture and/or fuel 30 in the chamber 18. An ignition source 98, controlled by a control module or controller 102, supplies a spark at which point the compressed fuel combusts and drives the piston 50 back to BDC. The controller 102 may also be configured to control the valves (not shown) at the intake port 26 and the out-take port 34 to control the rate by which combustible fluid, namely the fuel and/or oxidizer, may be mixed and fed into the chamber, or separately fed into the chamber 18. As the piston 50 returns again toward TDC, combusted exhaust gases 38 are forced through out-take port 34. The out-take port 34 is then closed, and intake port 26 is opened, and the four-stroke cycle may begin again. In this manner, a series of combustion cycles powers the crank shaft 58, which provides rotational energy 66 to an external application. In another aspect, the series of combustion cycles is used to drive a rapid response component that extracts the energy generated from the combustion and transfers it to an energy transfer component that converts the energy into usable power for powering and operating a powered device, such as a hydraulic pump. This concept is discussed in more detail below.

According to the present invention, the system 10 further comprises a rapid response component in the form of a secondary piston 70 disposed and supported within chamber 18. Secondary piston 70 includes a face, or energy receiving end 78, a secondary piston rod 74, and an impact portion 82 coupled to the secondary piston rod 74. The energy receiving end 78 may be positioned in chamber 18 to face primary piston 50 so that the longitudinal movement of the primary piston 50 and the secondary piston 70 corresponds with a longitudinal axis of chamber 18. In an inactive position, the energy receiving end 78 of the secondary piston 70 may be biased in a substantially sealed, retracted position against a lip or some other suitable sealing means, biased by a spring or by another suitable biasing force, such as a pressure reservoir, so that the secondary piston 70 is positioned in a biased manner prior to introducing fuel into the combustion portion 90 of the chamber 18 or prior to combustion during cyclic combustion of the system 100.

One important aspect of the present invention is that the secondary piston 70 includes a substantially lower inertia than that of the primary piston 50. Such a substantially lower inertia positioned adjacent the combustion portion 90 of the chamber 18 facilitates a rapid response to combustion, which provides linear movement 86 of the secondary piston 70 along the longitudinal axis of the chamber 18. Because the inertia of the secondary piston 70 is much lower than the inertia of the primary piston 50, the secondary piston 70 can efficiently extract a large fraction of the energy created by the combustion before it is otherwise lost to inefficiencies inherent in IC engines. With this arrangement, the energy receiving end 78 of the secondary piston 70 is sized, positioned and configured to react to combustion in the chamber 18 so as to provide linear movement 86 to the impact portion 82.

The system 10 further comprises a dynamic mass structure 110 configured to receive the energy extracted by the rapid response component of the IC engine from the combustion, and to transfer this energy into an energy transfer component 172 of a powered device 170. The powered device 170 may be any type of structure or system capable of being powered or operated as a result of the energy transfer component 172 being impacted by the dynamic mass structure 110. In one exemplary embodiment, the powered device 170 comprises a pump and the energy transfer component 174 comprises a pump piston, which operate to pump hydraulic fluid to an actuator. Different examples of powered devices are provided below.

The dynamic mass structure 110 comprises an energy receiving side 114 and an energy transferring side 118, and is supported by support means 122, which is configured to operably relate with displacement means 126 to allow the dynamic mass structure 110 to displace bi-directionally or otherwise between the rapid response component of the IC engine and the energy transfer component 172. The dynamic mass structure 110 is configured to receive the energy extracted by the rapid response component from the combustion in the IC. This exchange of energy takes place upon the rapid response component, in this case the secondary piston 70, interacting with the energy receiving side 114 of the dynamic mass structure 110. The interaction of these two components may be through impact or through other type of association, such as in the case where the dynamic mass structure 110 is situated adjacent or is juxtaposed to the secondary piston 70 in its initial position prior to combustion. Through this interaction, the energy extracted by the secondary piston 70 from the combustion in the IC engine is transferred to the dynamic mass structure 110, thus isolating the kinetic energy from its source, namely the IC engine.

One unique feature of the present invention is that the dynamic mass structure 110 allows the powered device 170 to operate completely independent of the IC engine and the power conversion system in communication with the IC engine, and particularly the rapid response component, or secondary piston 70. In addition, the dynamic mass structure 110 allows the IC engine to be optimized. The IC engine is preferably always operated and the rapid response component always acted upon to get or utilize the most power out of the IC engine and into the rapid response component. This is what is meant by optimizing the output of the IC engine. By utilizing a dynamic mass structure 110, the pressure upstream from the rapid response component does not influence or hinder the expulsion of the rapid response component because the two systems are independent of one another and separated by the dynamic mass structure 110. Stated differently, due to the presence of the dynamic mass structure 110, the operation of the IC engine and the rapid response component may be optimized to achieve a high level of output power, which output power may be transferred into the rapid response component to optimally displace the rapid response component as there is no load or pressure acting upon the rapid response component from the powered device 170 or any other system or device downstream. Indeed, the powered device 170 is generally incapable of affecting or acting directly upon the rapid response component in any way due to their separation and independent operation. The only interaction the powered device 170 and the rapid response component have with one another is through the dynamic mass structure 110.

Once combustion occurs, the rapid response component extracts at least a portion, and preferably an optimized portion, of the energy created during the combustion. Extraction of the generated energy results in a displacement of the rapid response component, wherein the energy from the combustion is converted into kinetic energy. In other words, the energy that is extracted is converted into kinetic energy through the motion or displacement of the rapid response component. As the IC engine is activated, its operation is optimized to displace the rapid response component the furthest distance and with the greatest load capacity using all or most all of the available energy produced from the combustion. As the rapid response component displaces, it interacts with the dynamic mass structure 110, which is situated adjacent or proximate the rapid response component in its initial starting or resting position. This interaction, which may or may not be in the form of an impact, functions to launch the dynamic mass structure 110 at a given velocity for a pre-determined distance, thus effectively transferring substantially all of the kinetic energy in the rapid response component to the dynamic mass structure 110. For any given throttle setting in the IC engine, the rapid response component is launched or accelerated to a given velocity. Thus, different throttle settings will translate into different velocities of the rapid response component, as well as different amounts of kinetic energy input into the rapid response component that is subsequently transferred into the dynamic mass structure 110. Upon causing the dynamic mass structure 110 to launch, the rapid response component returns to its initial starting position with its energy receiving face 78 once again adjacent the combustion portion 90. In this position, the rapid response component is once again ready to extract the energy generated by the next combustion cycle. In each cycle of the engine, the rapid response component is configured to displace at a given velocity and at a given frequency, depending upon the throttle speed of the engine, to produce a given power output that is always optimized. Although the velocity and frequency of the rapid response parasite 70 can be fixed or varied, most embodiments will function with a constant power output from the IC engine.

Launching the dynamic mass structure 110 and therefore transferring the kinetic energy from the rapid response component 70 into the dynamic mass structure 110 for later impact with an energy transfer component 172 of a powered device 170 functions to isolate the energy from its source, the IC engine, for a pre-determined period of time. This isolation of energy takes place once the dynamic mass structure 110 leaves the rapid response component and before the dynamic mass structure 110 impacts the energy transfer component 172 of the powered device 170. It is during this time that the dynamic mass structure 110 possesses, in kinetic form, the energy generated by the combustion of the IC engine and transferred to it by the rapid response component.

As indicated, the dynamic mass structure 110 receives the kinetic energy from the rapid response component and stores this kinetic energy until it impacts the energy transfer component 172 of the powered device 170. Impact with the energy transfer component 172 occurs after the dynamic mass structure 110 has traveled or displaced a pre-determined distance, which distance is defined by the distance between the point at which the rapid response component begins to transfer all of its energy into the dynamic mass structure 110 and the point at which the dynamic mass structure impacts the energy transfer component 172 of the powered device 170. This pre-determined distance may vary according to different design constraints. In addition, the dynamic mass structure 110 may displace a further distance after impact with the energy transfer component 172, depending upon the time it takes for the dynamic mass structure 110 to transfer all of its stored kinetic energy into the energy transfer component 172.

The amount of kinetic energy input into the energy transfer component 172 upon impact may vary with several factors, such as the size of the dynamic mass structure, the load placed on the dynamic mass structure, the load on the energy transfer component 172, the amount of energy generated by the combustion, the amount of energy loss between the rapid response component and the dynamic mass structure I 0, the amount of energy loss between the dynamic mass structure 110 and the energy transfer component 172, etc.

Support means 122 may comprise any structure or device capable of supporting the dynamic mass structure 110 in its static and dynamic states. In one exemplary embodiment, support means 122 may comprise an extension of chamber 18 as defined by an extension of chamber walls 22, wherein the dynamic mass structure 110 comprises displacement means 126 that function properly therein. In this embodiment, the support means 122 will comprise a design and function similar to that used to support secondary piston 70.

In another exemplary embodiment, support means 122 may comprise a structure independent of chamber 18, but that properly contains the dynamic mass structure 110. In this embodiment, the support means 122 is configured so that the dynamic mass structure 110 is in communication with chamber 18 and the rapid response component contained therein. The support means 122 is also configured so that the dynamic mass structure 110 is also in communication with powered device 170 and the energy transfer component 172 supported therein. Other types of support means 122 not specifically recited herein, but that function to support the dynamic mass structure 110, as well as to enable its displacement by the rapid response component, will be apparent and obvious to one skilled in the art and are intended to be covered herein.

The displacement means 126 may also comprise different embodiments configured to allow dynamic mass structure 110 to displace within support means 122. In one embodiment, displacement means 126 may comprise wheels, such as the wheels shown in FIG. 1. In another exemplary embodiment, displacement means 126 may comprise a lubricated surface to surface configuration, wherein the surfaces of the dynamic mass structure 110 are slidably disposed on and in contact with the surface of the support means 122. Lubrication may be added to increase the ability of the dynamic mass structure 110 to slide along the surface of the support means 122. In still another exemplary embodiment, the displacement means 126 may comprise wheels or bearings supported within support means 122 that are used to slidably support the dynamic mass structure 110 therein. Other types of displacement means 126 not specifically recited herein, but that function to facilitate and enable the displacement of the dynamic mass structure 110 by the rapid response component, will be apparent and obvious to one skilled in the art and are intended to be covered herein.

The dynamic mass structure 110 may comprise a mass of any size and any configuration suitable for the intended application. The size and configuration of the dynamic mass structure 110 may vary depending upon desired response, including the desired output power. It is contemplated that the properties of the dynamic mass structure 110 can be changed during engine cycles. As another embodiment, the dynamic mass structure 110 may comprise a resonant structure that moves back and forth.

Prior to the dynamic mass structure 110 being acted upon by the rapid response component, it is in its static resting state and comprises a velocity of $v_0$, with no kinetic energy stored therein. As acted upon by the rapid response component in response to the combustion in the IC engine, the dynamic mass structure 110 receives the kinetic energy from the rapid response component and is caused to accelerate. At the point of impact with the energy transfer component 172, the dynamic mass structure 110 comprises a final velocity $V_f$. This final velocity $V_f$, along with the size of the dynamic mass structure 110, having a mass in, determines the amount of force or momentum with which the dynamic mass structure 110 impacts the energy transfer component 172 according to the formula F=ma (or p (momentum)=$mv_f$), where m is the mass of the dynamic mass structure 110, and $a=(v_f-v_0)$.

Figure 5:
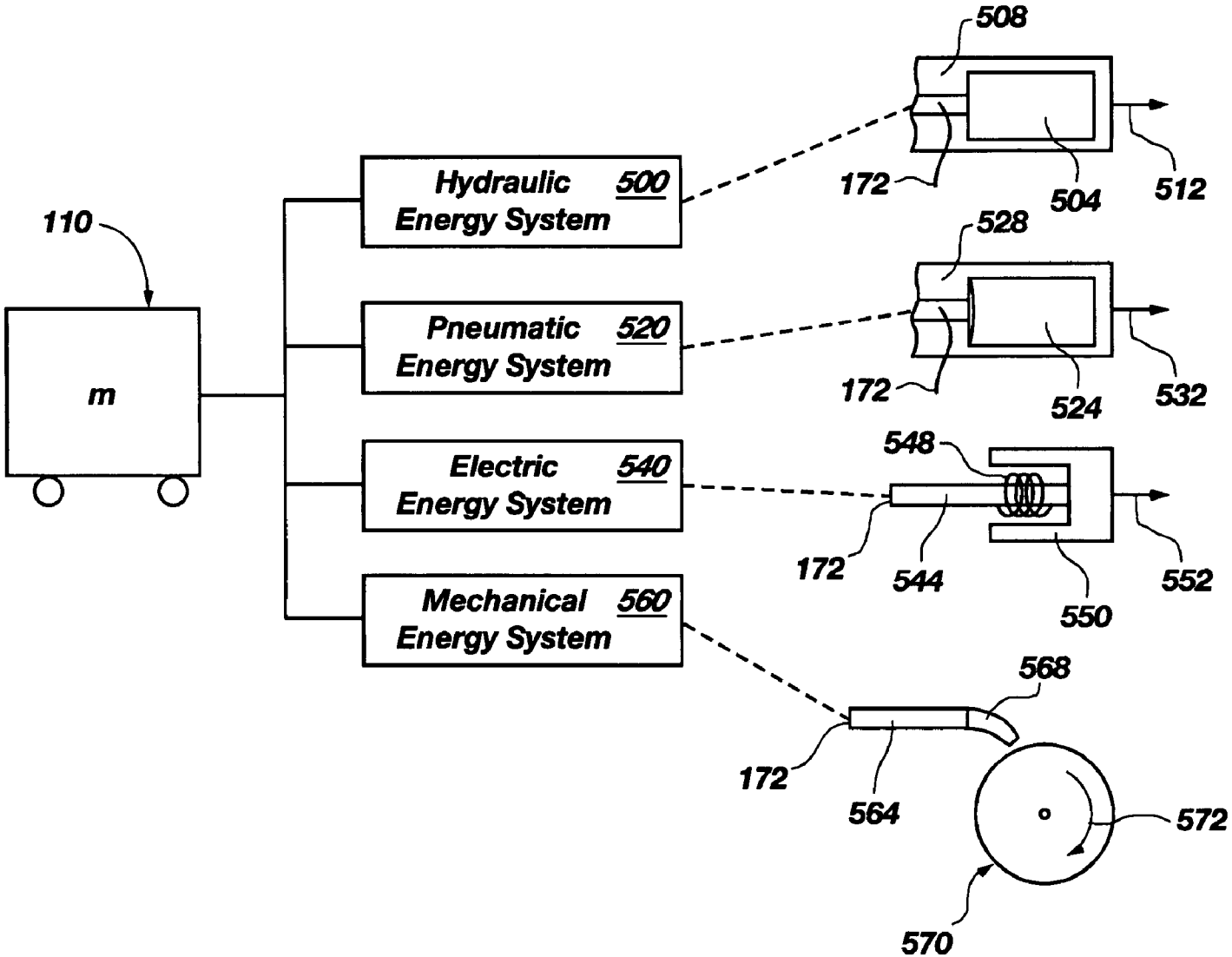
FIG. 5 illustrates a block diagram associated with various partial schematic side views, depicting various forms of energy transfer through an energy transfer component of the rapid response power conversion system.

The amount of kinetic energy stored in the dynamic mass structure 110 at the point of impact with the energy transfer component 172 is based on the formula $KE=\frac{1}{2} mv_f^2$. In one embodiment, the system may be configured so that the dynamic mass structure 110 transfers its KE instantly to the energy transfer component 172, wherein the dynamic mass structure 110 would comprise a final velocity $v_f=0$ at the point of impact. In another embodiment, the system may be configured so that the transfer of KE takes place over a pre-determined amount of time or within a pre-determined displacement distance following impact, wherein the KE is instead progressively transferred rather than instantaneously transferred. This gradual transfer may result from the type of load placed upon the energy transfer component, as well as a distance the energy transfer component may be allowed or required to displace itself. For example, if the powered device 170 was a hydraulic pump and the energy transfer component 172 was the hydraulic pump piston, the hydraulic pump piston would most likely be pre-loaded with some type of pressure acting on the side of the piston opposite that of the dynamic mass structure 110. As the dynamic mass structure 110 impacted the hydraulic piston, this would cause the hydraulic piston to displace a given distance depending upon the KE within the dynamic mass structure 110 and the opposing pressure force acting upon the hydraulic piston. In this situation, the KE may not be instantly transferred to the hydraulic piston, but would instead be transferred over time. In another example, if the energy transfer component 172 was a rod operably configured to turn a rotational device under a load, the ability of the rod to overcome the load and to turn the rotational device would be determined by the amount of KE stored in the dynamic mass structure 110 and the load acting on the rotational device and ultimately the rod. These examples are illustrated in FIG. 5 and discussed below.

Following the discussion above, an expression of available or potential output power produced by the powered device 170 may be described as a function of the kinetic energy KE stored in the dynamic mass structure 110 at the time of impact, as well as the load or energy acting upon and/or opposing the energy transfer component 172.

Since the dynamic mass structure 110 is designed to displace between the rapid response component and the energy transfer component, the present invention further features means for returning the dynamic mass transfer 110 to its initial starting position after impacting the energy transfer component, which initial starting position is adjacent or proximate the rapid response component. To accomplish this, and in one exemplary embodiment, the dynamic mass structure 110 may be biased using any type of known biasing means, such as a spring element. Other types of systems or devices used to retract the dynamic mass structure 110 will be obvious to one skilled in the art. In any event, the dynamic mass structure 110 must be retracted after impacting the energy transfer component 172 into its ready position to once again be acted upon by the rapid response component. This happens for each cycle of the IC engine. Thus, the dynamic mass component 110 goes from its initial starting position where it is acted upon and launched by the rapid response component to a position where it impacts the energy transfer component 172 and back again to its initial starting position to again receive the rapid response component in the next engine cycle.

Providing a dynamic mass structure as described and illustrated herein has several advantages over prior related systems. First, the rapid response component and the IC engine are allowed to operate independently of the device or system ultimately being powered. In other words, the pressure upstream from the rapid response component is independent of the IC engine and does not act on the rapid response component. Second, the rapid response system and the IC engine may be optimized to produce the highest and most efficient output power since they are not directly connected or in communication with, and therefore are not limited in any way by, the powered device or the constraints acting within or upon the powered device. Third, the physical constraints and properties of the dynamic mass structure may be varied to alter the displacement distance of the energy transfer component. Fourth, the dynamic mass structure can be configured so its launch is the second sum velocity. Fifth, the IC engine and rapid response component are optimized to maximize the extraction of energy generated by the IC engine, placed on the parasite, and put it into the dynamic mass structure no matter what the load is (e.g., the load on the rapid response component). This optimization is achieved at any throttle setting (e.g., at any pressure mode) of the IC engine. Sixth, when the dynamic mass structure impacts the energy transfer component (at this point the mass velocity is equal to 0), all of the energy in the dynamic mass structure is transferred into the energy transfer component. Seventh, the kinetic energy is isolated from its original source (the IC engine), thus reducing losses. Eighth, the properties of the dynamic mass structure are optimized to achieve maximum and/or most efficient displacement of the energy transfer component. Ninth, the size, configuration, and operational parameters of the IC engine may be altered to achieve different output powers. Other advantages will be recognized by those skilled in the art.

Figure 2:
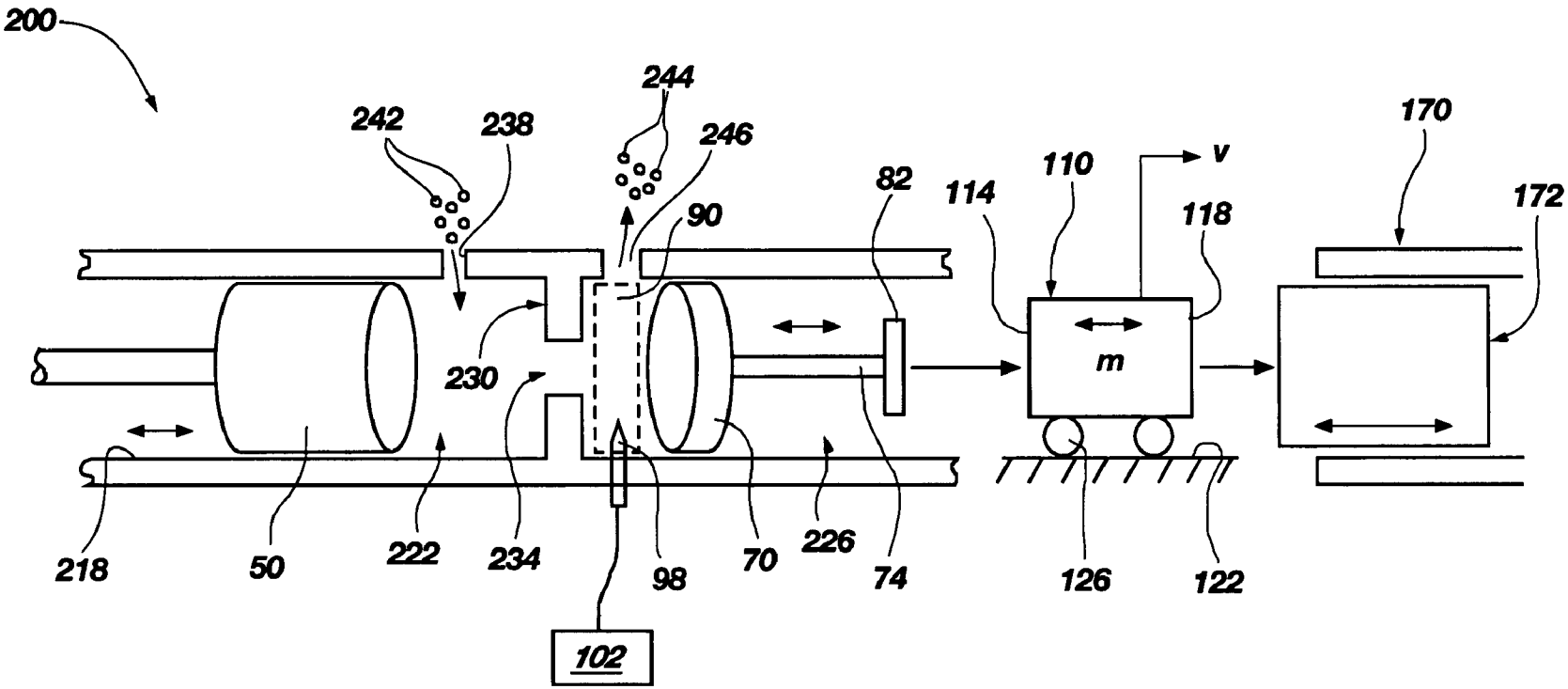
FIG. 2 illustrates a schematic side view of a DRPS according to another exemplary embodiment of the present invention.

With reference to FIG. 2, illustrated is a simplified schematic side view of a DRPS 200 according to another exemplary embodiment of the present invention. This embodiment is similar to the one described above for FIG. 1, except that the chamber 218 defines a first compartment 222 and a second compartment 226 with a divider portion 230 disposed therebetween. The divider portion 230 defines an aperture 234 therein, which aperture 234 extends between the first compartment 222 and the second compartment 226. With this arrangement, the primary piston 50 is positioned in the first compartment 222 and the rapid response component or the secondary piston 70 is positioned in the second compartment 226. The intake port 238 allows fuel 242 and/or combustible mixture to enter the first compartment 222. The fuel 242 and/or combustible mixture are pushed through the aperture 234 from the first compartment 22 into the second compartment 226 via the primary piston 50. The fuel 242 and/or combustible mixture is compressed at a combustion portion 90 of the chamber 226, which is directly adjacent the secondary piston 70. An ignition source 98 then fires the fuel for combustion, wherein the secondary piston 70 moves linearly, as indicated by the arrow, with a rapid response to the combustion. The combustive exhaust 244 then exits through the outtake port 246. It should be noted that the first compartment 222 and second compartment 226 may be remote from each other, wherein the first and second compartments 222 and 226 may be in fluid communication with each other via a tube.

Once the secondary piston 70 is caused to displace, the impact portion 82, as coupled to the secondary piston rod 74, acts upon the energy receiving side 114 of the dynamic mass structure 110 positioned adjacent or proximate the secondary piston 70. Acting upon the dynamic mass structure 110 effectuates a transfer of the kinetic energy in the secondary piston 70 to the dynamic mass structure 110, as discussed above. The dynamic mass structure 110 displaces until the energy transferring side 118 impacts the energy transfer component 172 of a powered device 170. When this happens, the dynamic mass structure 110 transfers its energy into the energy transfer component 172 of the powered device similar to that described above with reference to FIG. 1.

In the present embodiment, the primary piston 50 may reciprocate via combustion or an electric power source to push the fuel 242 from the first compartment 222 to the second compartment 226 of chamber 218. By having a divider portion 230, the combustion at the combustion portion 90 of the chamber 218 can be at least partially, or even totally, isolated from the primary piston 50. Depending on the requirements of the system 10, the controller 102 may be configured to open or close aperture 234 at varying degrees to isolate combustion from the primary piston 50. As such, in the instance of total isolation, a maximum amount of energy to the secondary piston 70 may be transferred by a rapid response to combustion. It is also contemplated that the primary piston 50 in the first compartment 222 may include a positive displacement compressor and/or an aerodynamic compressor, such as a centrifugal compressor.

Figure 3:
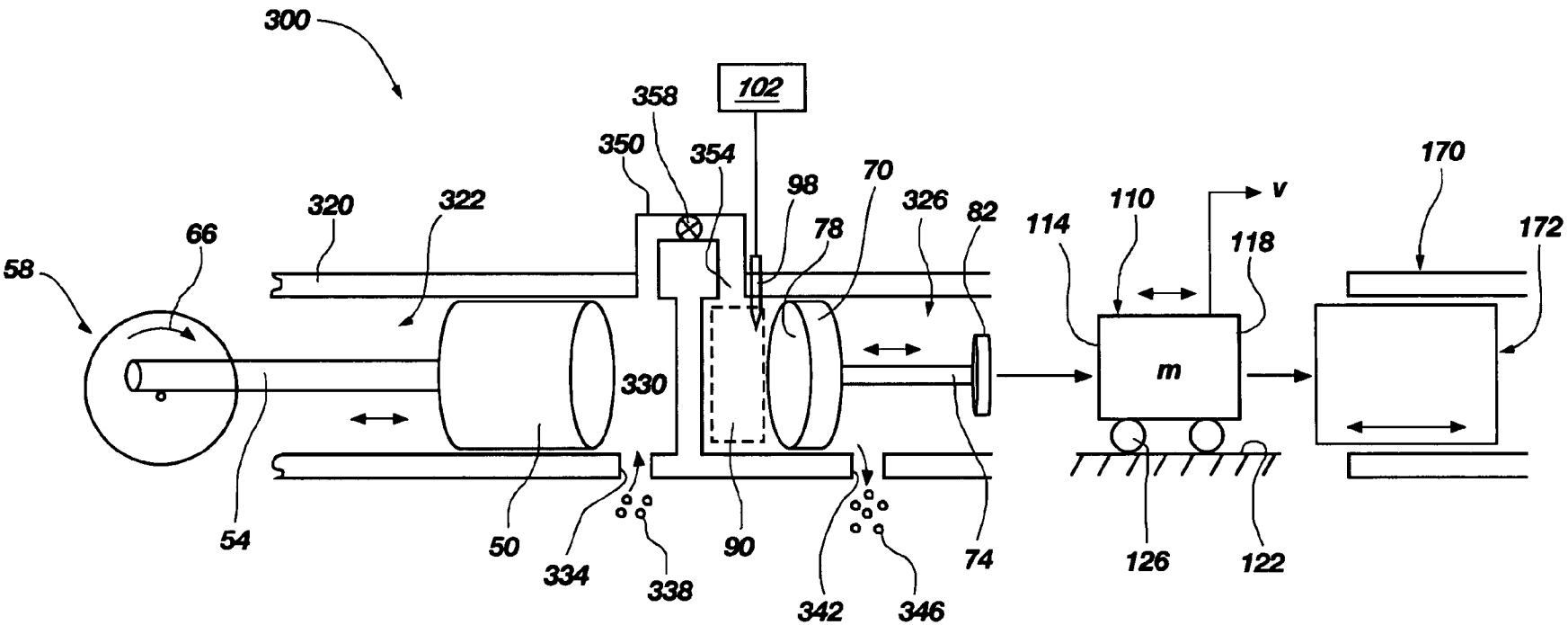
FIG. 3 illustrates a schematic side view of a DRPS according to still another exemplary embodiment of the present invention.

With reference to FIG. 3, illustrated is a schematic side view of a DRPS 300 according to still another exemplary embodiment of the present invention. Specifically, FIG. 3 illustrates a schematic side view of a rapid fire rapid response power conversion system according to one exemplary embodiment of the present invention. In this embodiment, the system 300 comprises a rapid fire internal combustion engine and a rapid response energy conversion system. The rapid fire internal combustion engine comprises a unique two-stroke engine designed to operate with the rapid response energy conversion system as described herein.

What is meant by "rapid fire" is the ability of the internal combustion engine to selectively and continuously drive the rapid response device or secondary piston by selectively controlling the injection of the fuel mixture into the combustion portion of the chamber (i.e., throttling), as well as the spark timing of the ignition source. The rapid fire internal combustion engine is a two-stroke engine that may be selectively operated so that combustion occurs and the secondary piston driven upon each cycle of the primary piston or upon select cycles so that the secondary actuates or is driven in bursts.

The exemplary rapid fire internal combustion engine shown in FIG. 3 comprises multiple chambers, namely first chamber 322 and second chamber 326 separated by a barrier wall or partition 330. The advantage of partition 330 is related to the combustion occurring within the combustion portion 90 of the second chamber 326, namely that the combustion portion 90, and hence the combustion, can be partially or totally isolated from the primary piston 50. As such, in the instance of total isolation, a maximum amount of energy can be transferred to the secondary piston 70 by a rapid response to combustion.

First and second chambers 322 and 326 are defined by chamber walls 320. First chamber 322 includes an intake port 334 for receiving a fuel/oil mixture and an oxidizer such as air or oxygen, separately or as a mixture. In the embodiment shown, mixture 338 comprises a fuel/oil/air mixture. Second chamber 326 includes an outtake port 342 for releasing combustive exhaust gasses 346. Intake port 334 includes a valve (not shown) configured to open and close at specified times to regulate the entrance of the fuel mixture 338 into chamber 322. Likewise, outtake port 342 includes a valve (now shown) configured to open and close at specified times to regulate the exhausting of the combusted exhaust gasses 346. First and second chambers 322 and 326 further fluidly communicate with one another through fuel transfer line 350, discussed below.

The internal combustion engine shown in FIG. 3 includes a local compression design in which a primary piston 50 is contained within the first chamber 322. The primary piston 50 may include a positive displacement compressor and/or an aerodynamic compressor, such as a centrifugal compressor. The primary piston 50 is interconnected to a piston rod 54, which in turn is interconnected to a crank shaft 58. The primary piston 50 is sized and configured to move linearly within the chamber 322 for converting linear movement from the primary piston 50 to the crank shaft 58 into rotational energy 66. Such rotational energy 66 may be used to power a wide range of external applications, such as any type of application that typically utilizes a two-stroke internal combustion engine.

The linear movement of the primary piston 50 takes place between a top dead center ("TDC") position and a bottom dead center ("BDC") position, in a similar manner and with similar results as discussed above.

The second chamber 326 comprises a rapid response component, again illustrated as secondary piston 70. As in other embodiments, the secondary piston 70 includes a face or energy receiving portion 78 that is adjacent or juxtaposed to the combustion portion 90 of the second chamber 22. Extending from the secondary piston 70 is a piston rod 74 that is coupled to an impact portion 82 configured to impact dynamic mass structure 110.

The energy receiving portion 78 may be positioned in the second chamber 326 to face primary piston 50 so that the longitudinal movement of the primary piston 50 and the secondary piston 70 corresponds with a longitudinal axis of both first and second chambers 322 and 326. In an inactive position, the energy receiving portion 78 of the secondary piston 70 may be biased in a substantially sealed, retracted position against a lip or some other suitable sealing means, and biased by a spring or by another suitable biasing force, such as a pressure reservoir, so that the secondary piston 70 is supported in a biased position prior to the introduction of the fuel mixture 338 into the combustion portion 90 of the second chamber 326 or prior to combustion during cyclic combustion of the system 300.

As in other embodiments, the secondary piston 70 includes a substantially lower inertia than that of the primary piston 50. Such a substantially lower inertia positioned adjacent the combustion portion 90 of the second chamber 22 facilitates a rapid response to combustion, which provides linear movement of the secondary piston 70 along the longitudinal axis of the second chamber 326. Because the inertia of the secondary piston 70 is much lower than the inertia of the primary piston 50, the secondary piston 70 can efficiently extract a large fraction of the energy created by the combustion before it is otherwise lost to inefficiencies inherent in prior related IC engines. In this embodiment, the energy receiving portion 78 of the secondary piston 70 is sized, positioned and configured to react to the combustion occurring within the combustion portion 90 of the second chamber 326 so as to provide linear movement to the energy receiving portion 78 to then act upon dynamic mass structure 110. Partition 330 further helps to contain the combustion and the amount of energy generated so that the transfer of energy into the secondary piston 70 may be maximized for each combustion.

The two-stroke cycle of the internal combustion engine begins with the primary piston 50 located at TDC. This is typically the position the primary piston 50 is in at combustion. As the piston 50 moves toward BDC, a fuel/oil/air mixture 338, which is a combustible mixture, is introduced into the first chamber 322 through intake port 334, which may include one or more openings and may also be a variable opening for varying the flow and amount of the fuel mixture 338 into the first chamber 322. Once the fuel mixture 338 enters the first chamber 322, the intake port 334 is closed and the primary piston 50 returns toward TDC, compressing the combustible fuel mixture 338 in the first chamber 322. This compression stroke forces the fuel mixture 338 through the fuel transfer line 350 and out of the fuel injection port 354. Transfer of the fuel mixture 338 through the fuel transfer line 350 is regulated by a type of regulation means commonly known in the art. As shown, one example of a regulation means may be a diode 358 or a type of valve structure that controls the flow of fluid through the fuel transfer line 350. The diode 358 controls the transfer of the compressed fuel mixture 338 out of the first chamber 322 and into the second chamber 326, where it collects in combustion portion 90 prior to being combusted. Intake port 334 may be opened and closed using a valve, or it may be positioned so that it is open and closed according to the displacement position of the primary piston 50 within the first chamber 18.

An ignition source 98, controlled by a controller 102, supplies a spark at which point the compressed fuel within combustion portion 90 combusts and drives the piston 50 back to BDC where again fuel mixture 338 is introduced into the first chamber 322. The controller 102 may also be configured to control the valves (not shown) at the intake port 334 and the outtake port 342, as well as the regulation means within the fuel transfer line 350 to control the rate by which the fuel mixture 338 enters the secondary chamber 326.

Upon combustion, the secondary piston 70 is caused to displace, thus extracting the energy generated from the combustion and converting it into usable kinetic energy, which is subsequently transferred into the dynamic mass structure 110. As the secondary piston 70 displaces from its initial starting position to a final position, it passes the outtake port 342. Upon passing the outtake port 342, the combusted exhaust gasses 346 are allowed to be purged from the secondary chamber 326. This may be via a valve or simply by the displacement of the secondary piston 70. Either way, the outtake port 342 is caused to be in fluid communication with the secondary chamber 326 once the piston advances far enough along. As the secondary piston 70 returns to its initial starting position, the fluid communication of the outtake port 342 with the secondary chamber 326 is cut off and a combustion portion 90 again provided.

As the primary piston 50 again advances to TDC, the fuel mixture 338 is compressed and transferred from the first chamber 322 into the combustion portion 90 of the second chamber 326 through fuel transfer line 350 and fuel injection port 354. At the TDC position, combustion again is initiated by the ignition source 102 and the two-stroke cycle starts over again. In this manner, a series of rapid, high powered combustion cycles is achieved. And, since the secondary piston 70 has a substantially lower inertia than that of the primary piston 50, its reaction time is much faster, thus allowing the secondary piston 70 to be displaced and repositioned even at high combustion rates or throttle speeds. Moreover, since the combustion of the fuel mixture 338 occurs once every cycle (instead of once every two cycles as in a four stroke engine) the system 300 is capable of functioning as a rapid, high power system.

Again as in other embodiments, once the secondary piston 70 is caused to displace, the impact portion 82, as coupled to the secondary piston rod 74, acts upon the energy receiving side 114 of the dynamic mass structure 110 positioned adjacent or proximate the secondary piston 70. Acting upon the dynamic mass structure 110 effectuates a transfer of the kinetic energy in the secondary piston 70 to the dynamic mass structure 110, as discussed above. The dynamic mass structure 110 displaces until the energy transferring side 118 impacts the energy transfer component 172 of a powered device 170. When this happens, the dynamic mass structure 110 transfers its energy into the energy transfer component 172 of the powered device similar to that described above with reference to FIG. 1.

Figure 4:
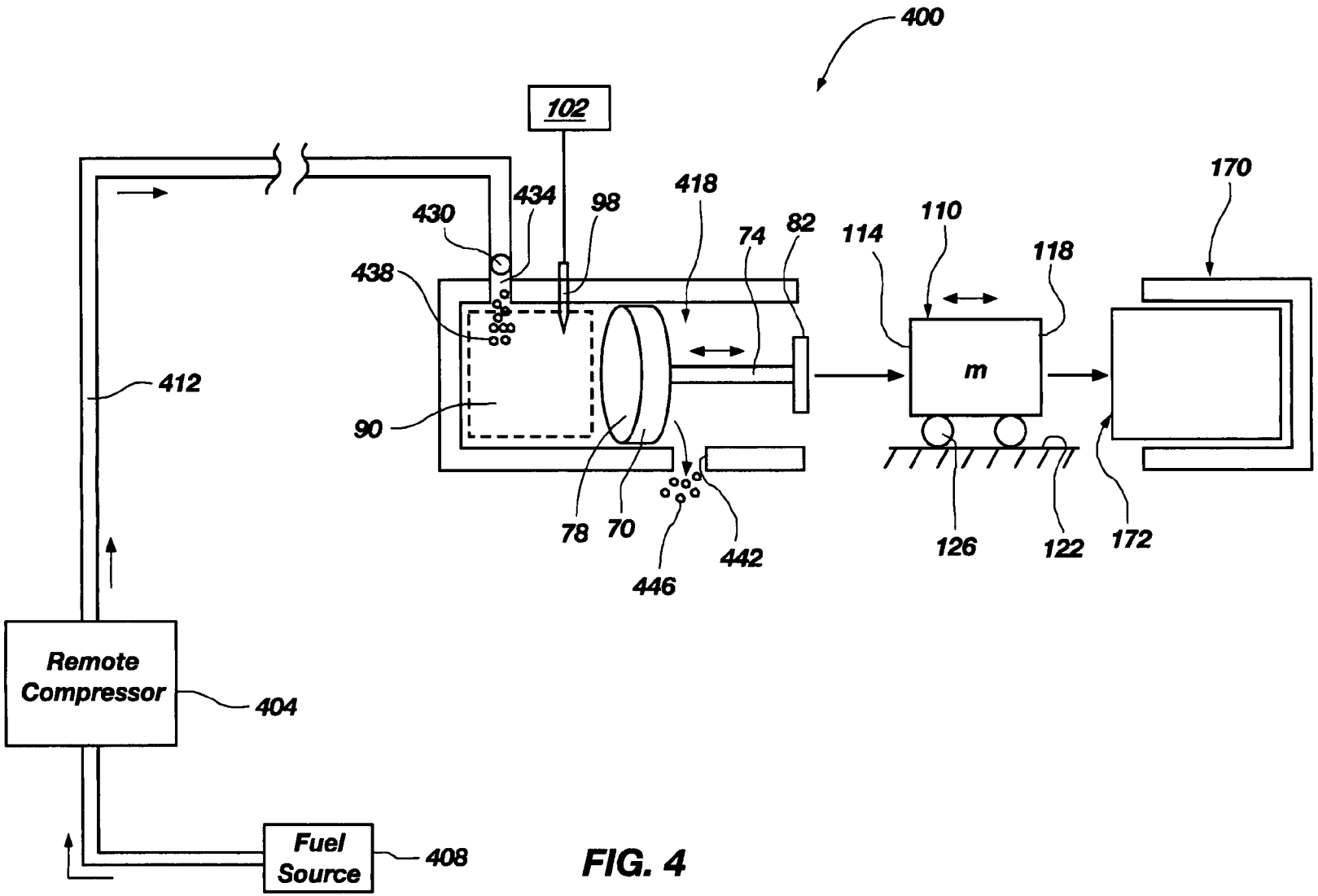
FIG. 4 illustrates a schematic side view of a DRPS according to still another exemplary embodiment of the present invention.

With reference to FIG. 4, illustrated is a schematic side view of a DRPS 400 according to still another exemplary embodiment of the present invention. This embodiment is similar to that illustrated in FIG. 3, only the system 400 comprises a remote compressor arrangement. Specifically, system 400 comprises a rapid fire IC engine operable with a rapid response power conversion system. As shown, the rapid fire IC engine comprises a remote compressor 404 configured to compress the fuel mixture 438 as received from fuel source 404 as commonly known in the art. Once compressed, the fuel mixture 438 is transferred through fuel line 412 where it is injected into chamber 418 through injection port 434. The injection of the fuel mixture 438 is regulated or controlled by regulation means 430, which may be a diode or a valve type structure.

As the fuel mixture 438 is injected into the chamber 418, and particularly the combustion portion 90, secondary piston 70 is in its initial starting position. In this position, outtake port 442 is blocked of or shut. The IC engine functions similar to that described in FIG. 3 in that ignition source 98, as controlled by control module 102, is initiated to combust the compressed fuel mixture 438. Upon combustion, the energy receiving portion 78 of the secondary piston 70 is acted upon causing the secondary piston 70 to undergo linear displacement through chamber 418. In this manner, the secondary piston 70 extracts the energy generated from the combustion and converts it into usable kinetic energy as explained above. As the secondary piston 70 passes the outtake port 442, the combusted exhaust gasses 446 are purged from the chamber 418. This process repeats several times during the two-stroke cycle of the IC engine and the remote compressor 404. It is noted that the remote compressor 404 may be any type of compression system known in the art for supplying a compressed fuel mixture to a combustion chamber for the purpose of operating an internal combustion engine.

The rapid response component or secondary piston 70 again acts upon the dynamic mass structure 110. Indeed, once the secondary piston 70 is caused to displace, the impact portion 82, as coupled to the secondary piston rod 74, acts upon the energy receiving side 114 of the dynamic mass structure 110 positioned adjacent or proximate the secondary piston 70. Acting upon the dynamic mass structure 110 effectuates a transfer of the kinetic energy in the secondary piston 70 to the dynamic mass structure 110, as discussed above. The dynamic mass structure 110 displaces until the energy transferring side 118 impacts the energy transfer component 172 of a powered device 170. When this happens, the dynamic mass structure 110 transfers its energy into the energy transfer component 172 of the powered device similar to that described above with reference to FIG. 1.

With reference to FIG. 5, illustrated is a block diagram associated with various partial schematic side views, depicting various forms of energy transfer through an energy transfer component of the rapid response power conversion system. Specifically, FIG. 5 illustrates that the energy transfer component 172 may include and/or may be coupled with any number of energy conversion devices. In particular, the energy transfer component 172 is configured to transfer the linear movement or displacement of the dynamic mass structure 110, and therefore the kinetic energy stored therein, to any one of hydraulic energy, pneumatic energy, electric energy and/or mechanical energy. Transferring linear motion into such various types of energy is well known in the art.

For example, in a hydraulic system 500, linear motion via the dynamic mass structure 110 transferred to a hydraulic piston 504 in a hydraulic chamber 508 may provide hydraulic pressure and flow 512, as well known in the art. Similarly, in a pneumatic system 520, the dynamic mass structure 110 may provide linear motion to a pneumatic piston 524 in a pneumatic chamber 528 to provide output energy in the form of pneumatic pressure and gas flow 532.

Other systems may include an electrical system 540 and a mechanical system 560. As well known in the art, in an electrical system 540, the linear motion of the dynamic mass structure 110 may be configured to impact an armature 544 with a coil 548 wrapped therearound, wherein the armature 544 reciprocates in the coil 548 to generate an electrical energy output 552. Furthermore, in the mechanical system 560, linear motion from the dynamic mass structure 110 may be transferred to rotational energy 572 with a pawl 568 pushing on a crank shaft 570 to provide rotational energy 572. Other methods of converting energy will be apparent to those skilled in the art. For example, rotational electric generators, gear driven systems, and belt driven systems can be driven by the dynamic mass structure 110 of the present invention.

Looking at each of the exemplary systems illustrated in FIG. 5, in each instance, the energy transfer component 172 is configured to travel a certain distance to perform its designated function in response to the impact by the dynamic mass structure 110. This distance is determined by a number of factors, including the load or force acting on the energy transfer component 172 by the powered device 170. For example, the opposing pressure in the pump acting on the pump piston 504 partially dictates the distance the pump piston 504 travels and what amount of energy is needed to drive the pump piston 504 to operate the pump. When the dynamic mass structure 110 hits the pump piston 504, how far the pump piston travels depends on the load acting on the pump piston. If the load is relatively high, a higher force and shorter stroke is achieved. If the load is relatively low, a lower force and longer stroke is achieved. The load on the pump piston 504 is independent of the engine, as only linked by the dynamic mass structure 110. Therefore, for every given output power from the IC engine (be it varied or constant) per cycle, the pump piston 504 will move or displace according to these factors—the output power of the IC engine, the weight of the dynamic mass structure, the velocity of the mass structure at impact, the load acting on the piston pump, and any losses due to friction. The same is true for the other devices. Indeed, a pump does not have to be the structure being driven by and opposite the IC engine and dynamic mass structure power conversion assembly. The dynamic mass structure may be configured to influence or act upon other structures or systems, as will be appreciated by those skilled in the art.

Figure 6:
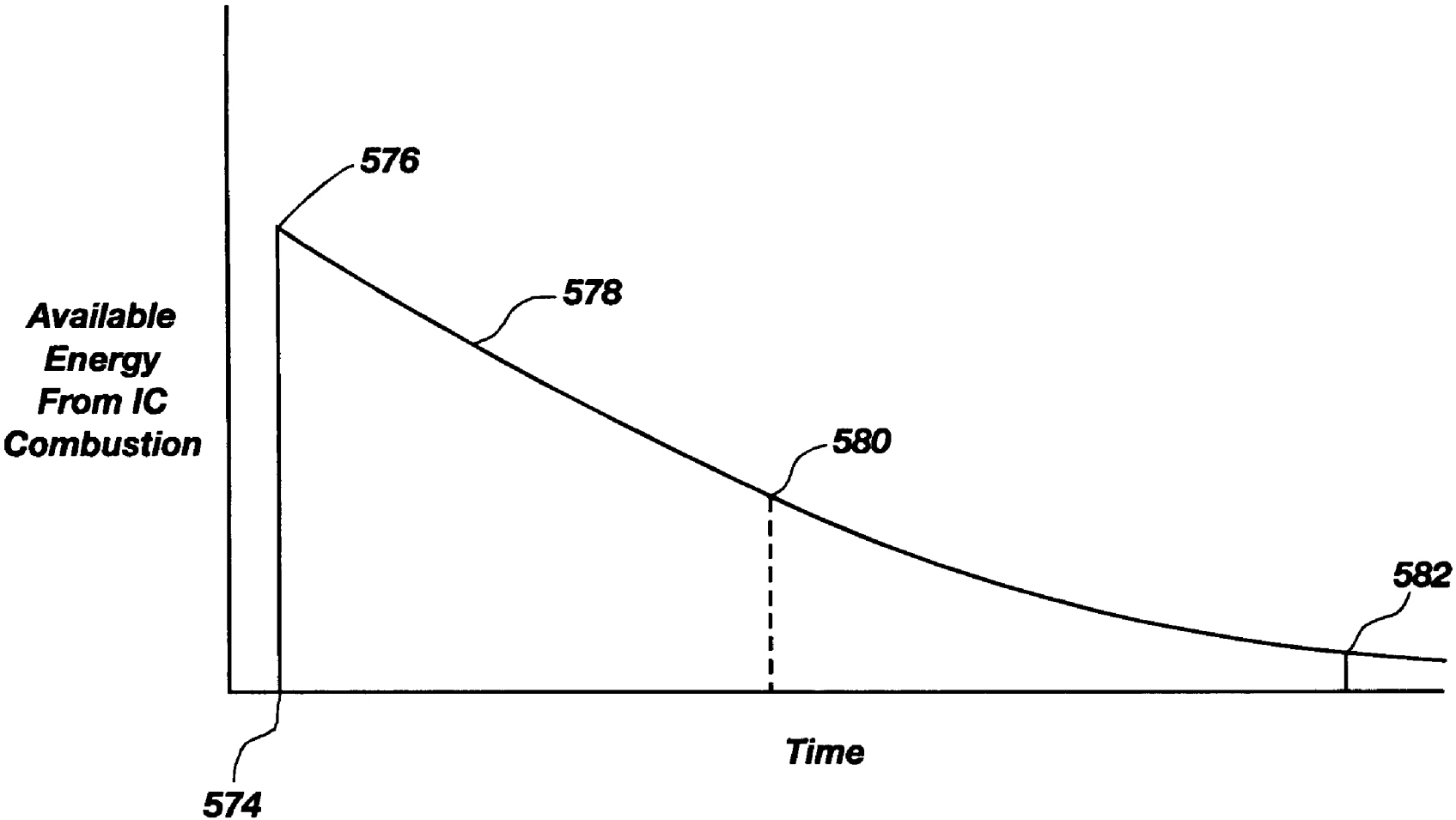
FIG. 6 illustrates a plot of the amount available energy, over time, as generated by an internal combustion engine and the extraction of this energy by the rapid response component.

FIG. 6 illustrates a plot of the amount available energy, over time, as generated by an internal combustion engine and the extraction of this energy by the rapid response component. Specifically, FIG. 6 illustrates a point in time, point 574, where combustion within the internal combustion engine occurs. At this point 574, the amount of available energy is the greatest, as represented by the point 576. This energy however, drops off over time as is represented by the curve 578, until it is either extracted or lost. The point 580 shown on the graph represents the point at which prior related IC engines exhaust the combusted gasses and begin to prepare for the next combustion. Therefore, everything to the left of point 580 is energy utilized by prior related IC engines, and everything to the right of point 580 is energy unused or wasted by prior related IC engines. Therefore, as can be seen, prior related IC engines are very inefficient and operate with significant losses. These losses are attributed to the many limitations in prior related IC engines, such as heat and pressure loss from friction and venting of spent gases.

Unlike prior related IC engines, the present invention DRPS is able to optimize the IC engine, and more particularly, the extraction of energy generated from the IC engine. The optimization of extracted energy results from the presence of the rapid response component and its interaction with the dynamic mass structure. Utilizing these two components, all or substantially all of the energy generated by the IC engine is used, rather than being wasted. Indeed, point 582 along the graph of FIG. 6 illustrates the point in time at which the rapid response component has extracted most, if not all, of the available energy. It is at this point that the rapid response component has displaced its greatest distance and is traveling at its greatest velocity. It is also at this point 582 that the rapid response component launches the dynamic mass structure, or rather the point at which the dynamic mass structure leaves the rapid response component, wherein the rapid response component has transferred all of its energy to the dynamic mass structure. The dynamic mass structure does not leave the rapid response component until all, or substantially all, of the available energy has been extracted by the rapid response component and transferred to the dynamic mass structure. The reason that the rapid response component is able to extract all or substantially all of the available energy is because it is separated from the powered device or load that the IC engine is intended to power. Thus, the rapid response component is able to displace until the optimal amount of energy from the combustion is extracted.

Figure 7:
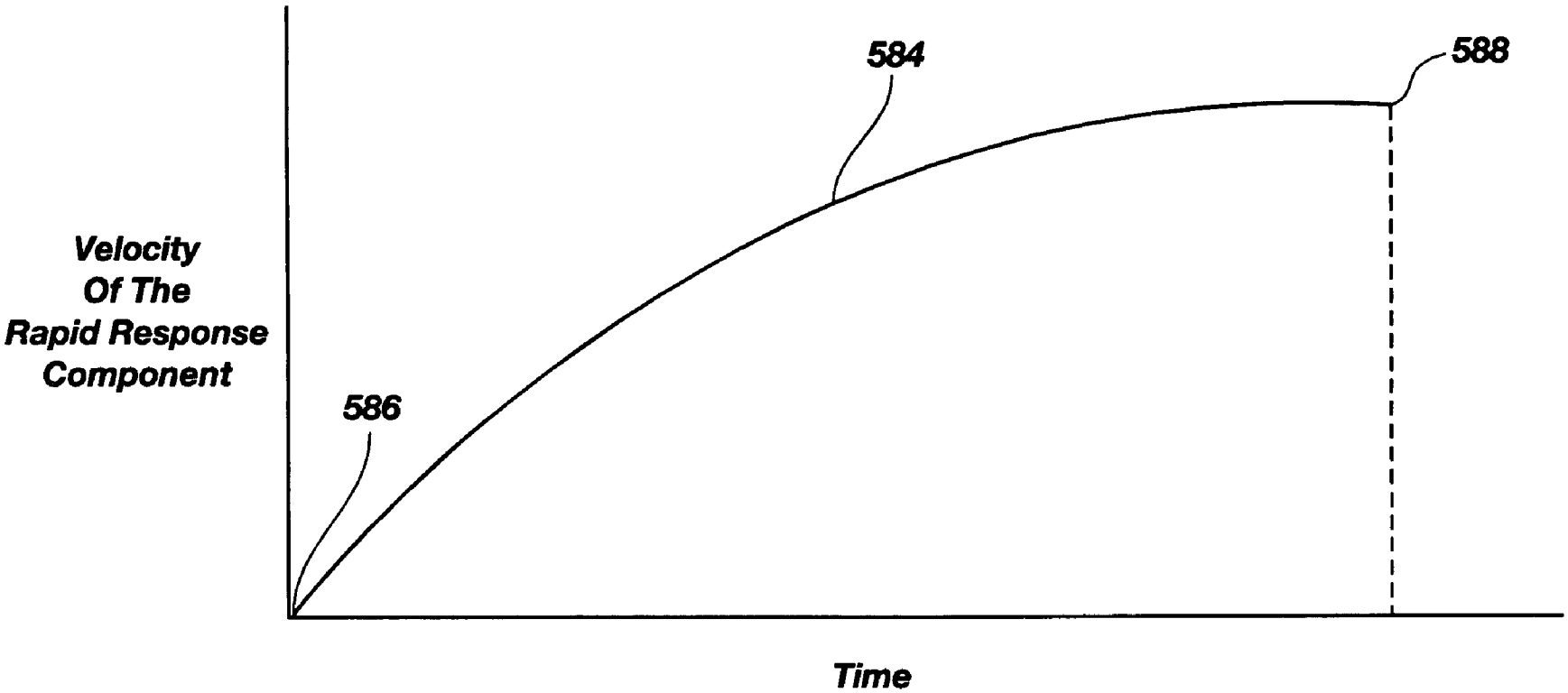
FIG. 7 illustrates a plot of the velocity of the dynamic mass structure, over time, as acted upon by the rapid response component.

As the rapid response component is extracting energy from the IC engine it is interacting to displace or launch the dynamic mass structure. FIG. 7 illustrates a plot of the velocity of the dynamic mass structure, over time, as acted upon by the rapid response component. As can be seen, at the point of combustion, point 586, the rapid response component has a velocity equal to zero. However, once combustion occurs, the rapid response component increases in velocity, as represented by the curve 584, until it reaches its peak or maximum velocity at point 588. It is at this point 588 that the rapid response component has extracted all of the available energy generated by the combustion, converted this energy into kinetic energy, and has transferred this kinetic energy to the dynamic mass structure. Thus, it can be said that at this point 588 the displacement, velocity, and kinetic energy of the rapid response component is optimized or maximized, or rather the extraction of available energy is optimized or maximized, as there is no longer any available energy to be extracted, and thus no more energy to be input or transferred to the dynamic mass structure. The term optimize or optimization may be thought of as extracting all, or substantially all, of the energy generated by the IC engine by the rapid response component, as well as the transfer of all, or substantially all, of this extracted and converted kinetic energy into the dynamic mass structure.

One skilled in the art will recognize that the present invention provides for variable torque output. Variable torque output is achieved as a result of the unique power conversion and energy extraction and transfer system described herein. Specifically, the kinetic energy transferred from the dynamic mass structure to the energy transfer component may be varied by manipulating or varying one or more of the characteristics of the dynamic mass structure itself, the timing of the combustion in the IC engine to produce different levels of energy, the characteristics of the rapid response component, and the load acting on the energy transfer component.

Moreover, one skilled in the art will recognize the advantage the present invention will have with respect to diesel engines. Indeed, the present invention is well suited for adaptation into a diesel engine because the timing of the combustion is irrelevant in terms of engine efficiency since the rapid response component extracts all or substantially all of the generated energy from the combustion every single cycle, no matter when combustion occurs (e.g., early or late).

At this point 588, the dynamic mass structure leaves or is launched by the rapid response component to impact the energy conversion device. Once impact occurs, the dynamic mass structure returns to its initial starting position to be acted upon again by the rapid response component, which also returns to its initial starting position after launching the dynamic mass structure, during the next combustion cycle.

Figure 8:
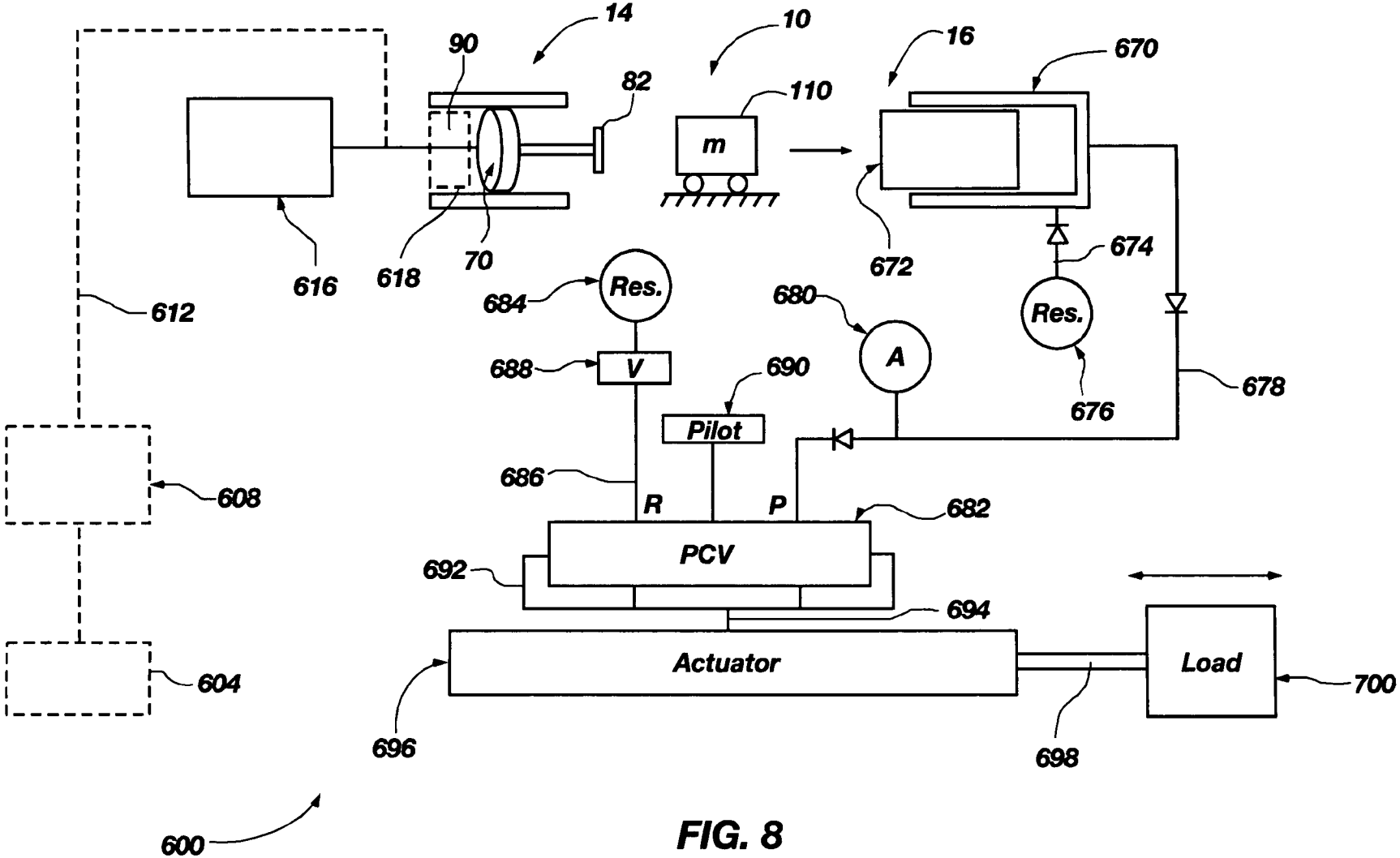
FIG. 8 illustrates a block diagram associated with various partial schematic side views, depicting the use of an exemplary DRPS to power a hydraulic pump used to provide hydraulic fluid to a pressure control valve configured to regulate the pressure and flow of hydraulic fluid in and out of an actuator attached to a load.

With reference to FIG. 8, illustrated is a block diagram associated with various partial schematic side views, depicting the use of a single exemplary DRPS 600 utilized to power a hydraulic pump used to provide hydraulic fluid to a pressure control valve, which is configured to regulate the pressure and flow of hydraulic fluid in and out of a single actuator attached to a load, which components may collectively be referred to herein as a powered actuator system. Specifically, in this embodiment, an internal combustion engine 14 is used to actuate or drive a rapid response device shown as secondary piston 70. In one aspect, the internal combustion engine 14 may comprise a local compressor 608 as discussed above. In another aspect, the internal combustion engine 14 may comprise a remote compressor 616 that receives fuel from fuel source 604, compresses it, and transfers it into the combustion portion 90 of a chamber 618 through fuel line 612, also as discussed above. In the embodiment shown, and upon combustion, the secondary piston 70 is caused to impact dynamic mass structure 110, which in turn impacts the energy transfer component 672 of the powered device 670, which is shown as a hydraulic pump and wherein the energy transfer component 672 is a hydraulic piston. Therefore, the rapid response device or secondary piston 70 is used to pump pressurized fluid, and particularly hydraulic fluid through line 678 into a pressure control valve 682. The pump operates to receive hydraulic fluid from a hydraulic reservoir 676 through reservoir line 674. Upon being actuated or powered by the internal combustion engine and power conversion system, the pump charges the accumulator 680, which is configured to provide the pressure control valve 682 with hydraulic fluid under various select pressures.

The pressure control valve 682 comprises a pressure inlet fluidly coupled to pressure line 678 and a return inlet fluidly coupled to a reservoir 684 through return line 686, which return line 686 is controlled by valve 688. Also fluidly coupled to the pressure control valve is a pilot valve 690 configured to provide a first stage pressure to the pressure control valve 682. Extending from the pressure control valve 682 is a main line 692 that is in fluid communication with load pressure feedback ports formed in opposite sides of the pressure control valve 682, as well as pressure and return outlet ports also formed in the pressure control valve 682 and that communicate with pressure and return inlet ports upon the selective positioning of first and second spools (not shown) strategically supported within the pressure control valve 682. The main line 692 is in further fluid communication with a load feed line 694 that is in turn in fluid communication with a load 700 acting through load support 698 and actuator 696. The specific functionality of the hydraulic pump, the pressure control valve 682, and the actuator 696 are more specifically set forth in U.S. patent application Ser. No. 11/293,413, filed Dec. 1, 2005, and entitled, "Pressure Control Valve Having an Intrinsic Feedback System" and U.S. patent application Ser. No. 11/293,726, filed Dec. 1, 2005, and entitled, "Pressure Control Valve Having an Intrinsic Mechanical Feedback System," each of which are incorporated by reference in their entirety herein.

In the configuration shown, the DRPS 600 is used to drive the actuator 696, which in turn drives the load 700. The rapid fire IC engine 14 is capable of generating large amounts of energy in quick bursts or in a more steady or constant manner, depending upon the timing of the combustion and the throttling of the system. This rapid energy generation function is transferred or converted through the rapid power conversion system 16 to achieve rapid output power that is used to drive the dynamic mass structure 110 to power the hydraulic pump. The hydraulic pump rapidly responds by providing the necessary pressure into the pressure control valve 682 to accurately and timely drive the actuator 696 and ultimately the load 700. The use of a high power rapid fire power conversion system is advantageous in this respect in that the actuator is capable of driving the load using large amounts of power received in short amounts of time and on demand. Therefore, there are few losses in the system between the internal combustion engine and the actual driving of the actuator and load, as well as an increase in output power. For example, without describing the specific functions of the pilot and pressure control valves, if the load 700 was to be continuously driven or held in place to overcome gravitational forces, the rapid fire internal combustion engine could be continuously throttled to produce constant energy that may be converted into usable power by the power conversion system. The pump would be continuously operated to supply the necessary pressurized hydraulic fluid needed to sustain the actuator in the drive mode. In another example, if the actuator 696 was to be actuated and the load 700 driven periodically (either randomly or in systematic bursts), the rapid fire internal combustion engine could be periodically throttled to produce rapid bursts of energy. In this example, the pump would be periodically operated to supply the necessary pressurized hydraulic fluid needed to drive the actuator for a specified or pre-determined amount of time. The advantage of the rapid fire internal combustion engine coupled with the rapid response and energy extraction of the power conversion device, the system is capable of producing large and explosive amounts of output power in a short amount of time over prior related four-cycle or four-stroke systems.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

More specifically, while illustrative exemplary embodiments of the invention have been described herein, the present invention is not limited to these embodiments, but includes any and all embodiments having modifications, omissions, combinations (e.g., of aspects across various embodiments), adaptations and/or alterations as would be appreciated by those in the art based on the foregoing detailed description. The limitations in the claims are to be interpreted broadly based the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not expressly recited, except in the specification. Accordingly, the scope of the invention should be determined solely by the appended claims and their legal equivalents, rather than by the descriptions and examples given above.

What is claimed and desired to be secured by Letters Patent is:

1. A rapid response power conversion system comprising:

a chamber having at least one fluid port configured to supply combustible fluid to said chamber, and an out-take port;

a local compressor for displacing a piston within said chamber, said piston and said at least one fluid port configured to selectively provide a variable pressure to said chamber and to at least partially facilitate a combustion therein;

a controller for initiating and controlling said combustion of said combustible fluid in a combustion portion of said chamber to generate energy;

a rapid response component in fluid communication with said chamber and said combustion portion of said chamber, said rapid response component configured to extract an optimized portion of said available energy generated from said combustion and to convert said optimized portion of said energy into kinetic energy;

an energy transfer component independent of said rapid response component and configured to convert available energy to power a powered device;

a dynamic mass structure situated between said rapid response component and said energy transfer component, said dynamic mass structure configured to receive and store said kinetic energy upon interacting with said rapid response component, wherein said dynamic mass structure is displaced and caused to impact said energy transfer component to transfer substantially all of said kinetic energy into said energy transfer component to power said powered device.

2. The rapid response power conversion system of claim 1, wherein said rapid response component comprises a secondary piston disposed in said chamber, said secondary piston comprising an energy receiving portion and an impacting portion, said energy receiving portion configured to draw said optimized portion of said energy generated from said combustion in said chamber.

3. The rapid response power conversion system of claim 2, wherein said impacting portion is configured to transfer said optimized portion of said energy received from said combustion to said dynamic mass structure.

4. The rapid response power conversion system of claim 1, wherein said energy transfer component converts said kinetic energy received from said dynamic mass structure into at least one form of usable energy selected from the group consisting of hydraulic energy, pneumatic energy, electric energy and mechanical energy.

5. The rapid response power conversion system of claim 1, wherein said rapid response component is configured to return to an initial starting position after transferring said kinetic energy to said dynamic mass structure.

6. The rapid response power conversion system of claim 1, wherein said dynamic mass structure displaces a predetermined distance prior to impacting said energy transfer component.

7. The rapid response power conversion system of claim 1, wherein said dynamic mass structure comprises a predetermined mass.

8. The rapid response power conversion system of claim 1, wherein said dynamic mass structure is configured to return to its initial starting position adjacent said rapid response component after impacting said energy transfer component and prior to a subsequent combustion.

9. The rapid response power conversion system of claim 1, wherein said dynamic mass structure is biased to return to its initial starting position adjacent said rapid response component after impacting said energy transfer component and prior to a subsequent combustion.

10. The rapid response power conversion system of claim 1, wherein said rapid response component is biased to return to its initial starting position prior to a subsequent combustion.

11. The rapid response power conversion system of claim 1, wherein said controller comprises a spark ignition source configured to at least partially facilitate said combustion in said chamber.

12. The rapid response power conversion system of claim 1, wherein said controller comprises a fuel controller for combining a fuel with an oxidizer to at least partially facilitate said combustion in said chamber.

13. The rapid response power conversion system of claim 12, wherein said oxidizer is selected from the group consisting of pure oxygen and air.

14. The rapid response power conversion system of claim 1, wherein said controller includes structure for releasing a fuel into compressed oxidizer fluid to at least partially facilitate said combustion in said chamber.

15. The rapid response power conversion system of claim 1, wherein said chamber is configured to operate in combination with an engine selected from the group consisting of a spark ignition internal combustion engine and a compression ignition internal combustion engine.

16. The rapid response power conversion system of claim 1, wherein said rapid response component is configured to provide greater bandwidth than direct bandwidth supplied directly by said piston of said internal combustion engine.

17. The rapid response power conversion system of claim 1, wherein said rapid response component is configured to draw said portion of said energy from said chamber during a time period from a proximate instant of said combustion and prior to said piston reciprocating to a position at a median between a top dead center position and a bottom dead center position.

18. The rapid response power conversion system of claim 1, wherein said piston is configured to substantially continuously reciprocate in said chamber.

19. The rapid response power conversion system of claim 14, wherein said controller is configured to initiate said combustion at selected cycles of one or more cycles of said piston, wherein said selected combustion cycles are non-continuous.

20. A rapid response power conversion system comprising:

a chamber having at least one fluid intake port configured to receive combustible fluid into said chamber, and an outtake port;

a remote compressor in fluid communication with said chamber and configured to selectively provide compressed combustible fluid at a variable pressure to said chamber through said fluid intake port to at least partially facilitate combustion therein;

a controller for initiating and controlling a combustion of said combustible fluid in a combustion portion of said chamber to generate energy;

a rapid response component in fluid communication with said chamber and said combustion portion of said chamber, said rapid response component configured to extract an optimized portion of said energy generated from said combustion and to convert said optimized portion of said energy into kinetic energy;

an energy transfer component independent of said rapid response component and configured to convert available energy to power a powered device;

a dynamic mass structure situated between said rapid response component and said energy transfer component, said dynamic mass structure configured to receive and store said kinetic energy upon interacting with said rapid response component, wherein said dynamic mass structure is displaced and caused to impact said energy transfer component to transfer substantially all of said kinetic energy into said energy transfer component to power said powered device.

21. A method of powering a powered device comprising:

providing an internal combustion engine configured to generate energy from a combustion occurring within a combustion chamber and to power a powered device;

providing a rapid response component to be in fluid communication with said combustion chamber, said rapid response component configured to displace in response to said combustion and to extract said generated energy and convert said energy into kinetic energy;

providing an energy transfer component separate from and independent of said rapid response component, said energy transfer component operably coupled to said powered device and configured to power said powered device from said energy generated from said internal combustion engine;

operating said internal combustion engine to generate said energy from said combustion;

configuring said rapid response component to displace in response to said combustion until substantially all of said energy generated in said combustion is extracted, said rapid response component converting said energy to kinetic energy;

providing a dynamic mass structure configured to interact with said rapid response component, said dynamic mass structure independent of said rapid response component and said energy transfer component;

causing said rapid response component to interact with said dynamic mass structure to transfer at least a portion of said kinetic energy into said dynamic mass structure, said interaction causing said dynamic mass component to displace;

configuring said dynamic mass structure to depart from said rapid response component; and causing said dynamic mass structure to impact said energy transfer component to transfer said kinetic energy in said dynamic mass structure into said energy transfer component, wherein said energy transfer component converts said kinetic energy into usable energy capable of powering and operating said powered device.

22. The method of claim 21, further comprising returning said rapid response component to an initial starting position prior to a subsequent engine cycle.

23. The method of claim 21, further comprising returning said dynamic mass structure to an initial starting position prior to a subsequent engine cycle.

24. The method of claim 21, wherein said dynamic mass structure departs from said rapid response component at the moment all of said kinetic energy from said rapid response component is transferred to said dynamic mass structure.

25. A method for optimizing the output power of an internal combustion engine, said method comprising:

operating an internal combustion engine to generate energy from a combustion occurring within a combustion chamber;

positioning a rapid response component in fluid communication with said combustion chamber, said rapid response component configured to extract and convert into kinetic energy said energy generated by said internal combustion engine; and configuring said rapid response component to displace in response to said combustion until substantially all of said energy is extracted and converted into kinetic energy; and causing said rapid response component to interact with and displace an independent dynamic mass structure to transfer substantially all of said kinetic energy to said dynamic mass structure, said rapid response component being caused to come to rest upon said transfer, with said dynamic mass structure continuing in motion, thus isolating said kinetic energy from said rapid response component.

26. The method of claim 25, further comprising configuring said dynamic mass structure to depart from said rapid response component after substantially all of said kinetic energy is transferred to said dynamic mass structure.

27. The method of claim 26, further comprising returning said rapid response component and said dynamic mass structure to an initial starting position prior to a subsequent engine cycle.

28. The method of claim 25, further comprising causing said dynamic mass structure to impact an energy transfer component to transfer substantially all of said kinetic energy into said energy transfer component.

* * * * *